US005419285A

United States Patent [19]

Gurevich et al.

[11] Patent Number: 5,419,285

[45] Date of Patent: May 30, 1995

[54] BOILER ECONOMIZER AND CONTROL SYSTEM

[75] Inventors: Arkadiy Gurevich; Akber Pasha, both of Louisville, Ky.

[73] Assignee: Henry Vogt Machine Co., Louisville, Ky.

[21] Appl. No.: 233,369

[22] Filed: Apr. 25, 1994

[51] Int. Cl.[6] ..... F22D 7/00; F22D 1/00

[52] U.S. Cl. ..... 122/406.1; 122/414; 122/477

[58] Field of Search ..... 122/406.1, 477, 414

[56] References Cited

U.S. PATENT DOCUMENTS

| | | | |
|---|---|---|---|
| 1,725,399 | 8/1929 | La Mont et al. . | |
| 1,743,326 | 1/1930 | Davy . | |
| 2,003,419 | 6/1935 | Artsay . | |
| 2,594,471 | 4/1952 | Marshall . | |
| 2,718,218 | 9/1955 | Gray . | |
| 2,805,652 | 9/1957 | Stout . | |
| 3,150,487 | 9/1964 | Mangan et al. . | |
| 3,422,800 | 1/1969 | La Haye . | |
| 3,505,811 | 4/1970 | Underwood . | |
| 3,756,023 | 9/1973 | Berman | 122/406.1 |
| 3,867,811 | 2/1975 | Waeselynck . | |
| 3,958,412 | 5/1976 | Frederick . | |
| 4,067,557 | 1/1978 | Inubushi et al. . | |
| 4,204,401 | 5/1980 | Earnest . | |
| 4,315,485 | 2/1982 | Kawamura et al. | 122/406.1 |
| 4,582,027 | 4/1986 | Cuscino et al. | 122/477 |
| 4,593,654 | 6/1986 | McInerney . | |
| 4,648,242 | 3/1987 | Griesinger . | |
| 4,662,390 | 5/1987 | Hawkins . | |
| 4,693,077 | 9/1987 | Skarvan et al. . | |
| 4,841,918 | 6/1989 | Fukayama et al. . | |
| 5,053,978 | 10/1991 | Solomon . | |
| 5,224,445 | 6/1993 | Gilbert, Sr. . | |

*Primary Examiner*—Henry C. Yuen
*Assistant Examiner*—Weilun Lo
*Attorney, Agent, or Firm*—Camoriano & Smith

[57] ABSTRACT

An increased efficiency boiler is provided, which, instead of trying to eliminate steaming in the economizer, designs the economizer to permit steaming, and a control is provided for the boiler which takes into account the heat input to the boiler as well as the water level in the steam drum and the reliability of the economizer.

3 Claims, 5 Drawing Sheets

BOILER ECONOMIZER AND CONTROL SYSTEM

BACKGROUND OF THE INVENTION

The present invention relates to boilers, and, in particular, to a boiler which includes an evaporator and an economizer.

In boilers of the type referred to above, water enters the economizer at a relatively low temperature and, in the economizer section of the boiler, is usually heated to just below the boiling point. Then, the hot water passes into the evaporator portion of the boiler, where it boils. The water and steam are separated in a drum, and the steam may then go on to a superheater, where it is heated to a temperature higher than its boiling temperature. The steam which leaves the boiler may then go to a turbine, where it performs work.

In the prior art, there have been many problems with these boilers. There is sometimes a problem with vaporization taking place in the economizer. In many cases, in order for the boiler to work most efficiently, the water which leaves the economizer must be close to the boiling point. However, if the water begins to boil in the economizer section, it can cause problems. The vapor can become trapped, causing vapor lock and water hammering, as well as fatigue, which can damage the boiler.

This problem occurs often under transient conditions. For example, if there is a need for a greater steam flow, the valve in the steam output line from the boiler is opened, reducing the pressure in the boiler. With the reduced pressure, more fluid boils in the evaporator. The rising volume of steam bubbles in the boiling water causes the water level in the drum to rise. If the water level goes too high, the steam quality is reduced, with some water entrained in the steam, and some water can enter the superheater and eventually damage it. Even if the steam does not go on to a superheater, the steam quality is important, and the water level in the drum must be maintained in order to maintain the steam quality. To prevent the water level from becoming too high, the water input to the boiler is reduced. With less water flow into the economizer, the water in the economizer is more likely to boil, creating the vapor lock, water hammer, and fatigue problems.

A common solution to this problem is to put a control valve or a small orifice in the line between the economizer and the evaporator, controlling the feed water supply, in order to raise the pressure in the economizer, making it more difficult for the water to boil. However, that means that the boiling takes place in the control valve or orifice instead, causing the valve or orifice to fail. It also means that more power is consumed, because the feed water pump must pump water across that large pressure drop, thus decreasing the efficiency of the power plant.

Another common solution is, once boiling begins in the economizer, to cause the feed water to bypass the economizer and go directly to the evaporator. This means that the economizer is not functioning for a good part of the time the boiler is operating, thereby greatly reducing the efficiency of the boiler. It also means that the economizer cycles between hot and cold as it goes from dry to wet, which causes wear and tear on the economizer.

U.S. Pat. No. 4,582,027 "Cuscino" shows a boiler in which the problem of boiling in the economizer is partially addressed. In this patent, a well-known bypass is provided, so that, under low load and start-up conditions, some of the fluid that has gone through the economizer does not go to the evaporator but is, instead, returned to the economizer. This keeps flow rates high enough to prevent boiling in the economizer. The teaching of this patent is intended to solve the problem of steaming in the economizer only during start-up and low load conditions, and for short periods of time—not during high flow rate conditions, where the boiler should be operating to be most efficient.

SUMMARY OF THE INVENTION

The present invention provides a boiler which is very efficient, because its economizer can operate continuously, whenever the boiler is in operation.

One embodiment of the present invention provides an economizer which includes at least one upwardly-flowing, single pass module at the end of the economizer so that, if the fluid boils at the end of the economizer, there is no problem. Instead of making various efforts trying to prevent steaming in the economizer section, as taught in the prior art, the present invention designs the economizer section so that steaming in at least part of the economizer does not create a problem. This means that the economizer can operate in the most efficient temperature range, bringing water right up to the boiling point, without causing problems. This also eliminates the need for valving or orifices to cause the pressure to be much higher in the economizer than in the evaporator.

One embodiment of the present invention provides a control system which effectively controls the feed water supply to the boiler so that the boiler continues to operate reliably, even under transient conditions. This control system can function with an economizer comprised of vertical tubes as shown in the drawings as well as with other types of economizers, including, for example, those with horizontal or inclined tubes.

DESCRIPTION OF THE PREFERRED EMBODIMENTS

Figure 1:
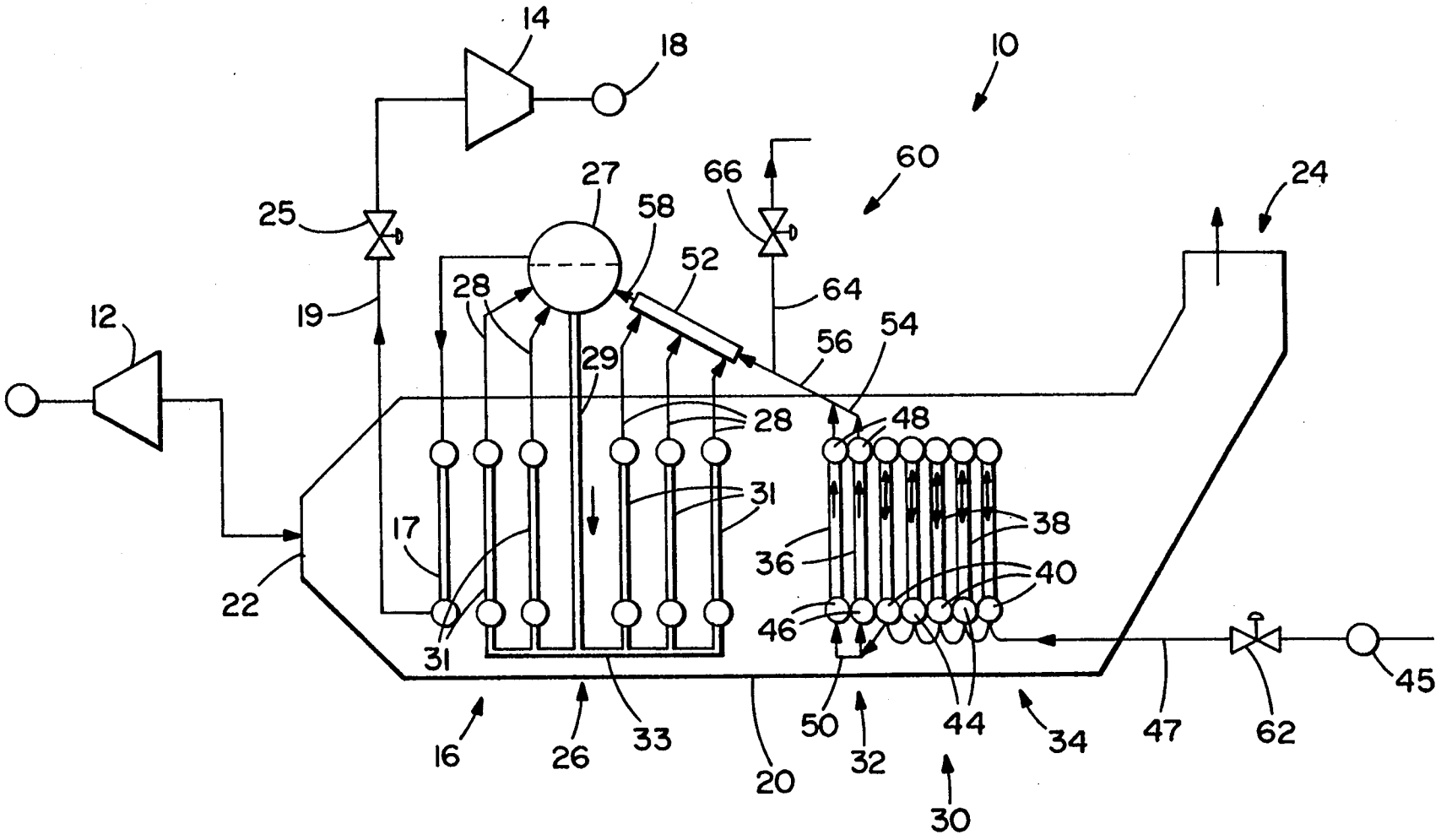
FIG. 1 shows a schematic side view of a first embodiment of a heat recovery steam generator made in accordance with the present invention.
Figure 2:
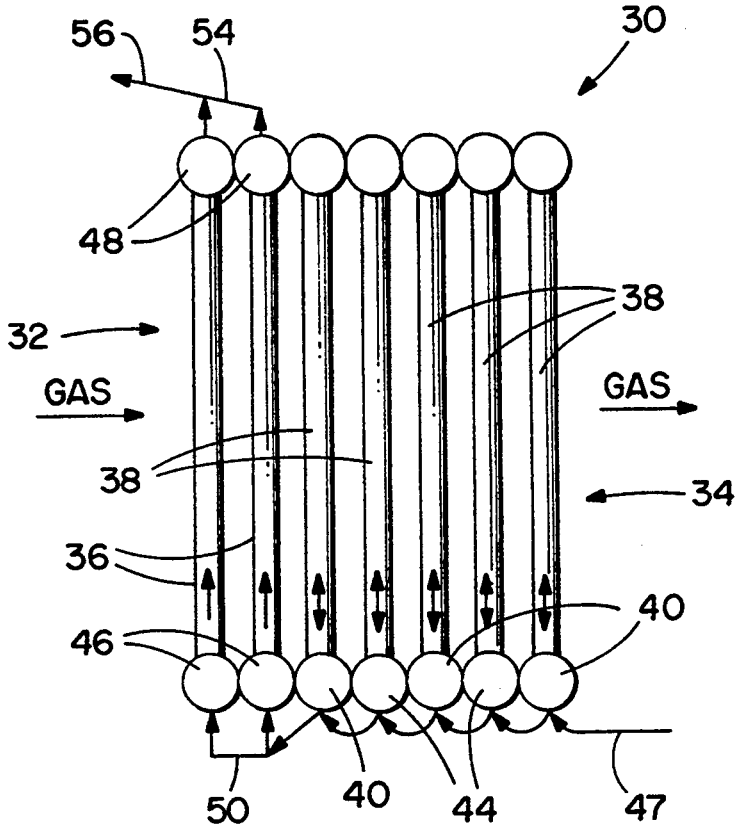
FIG. 2 is an enlarged side view of the economizer portion of the steam generator of FIG. 1.

FIG. 1 shows a combined cycle power plant 10, in which the exhaust from a gas turbine 12 is used to provide heat for a steam boiler 16. The steam from the boiler 16 drives a turbine 14, which drives a load 18, such as an electrical generator.

The steam boiler 16 includes a horizontal gas duct 20, having a gas inlet 22 at the upstream end and a gas outlet 24 at the downstream end.

The steam boiler 16 receives water from a feedwater supply pump 45. The water passes through a water inlet control valve 62, through a water inlet conduit 47, and into the boiler 16. The water first passes through an economizer section 30, where the water is heated to a temperature that is close to boiling, then through a conduit 56 to a drum 27. The water then passes down through a conduit 29 in the evaporator section 26. In the evaporator section 26, the water is heated to the boiling point.

It should be noted that, when referring to the flow of heating gas in this description, upstream is in the direction from which the heating gas enters the boiler (generally left in FIG. 1), and, when referring to the flow of water in this description, upstream is in the direction from which the water enters the boiler (generally right in FIG. 1). Since the water and heating gas flow in generally opposite directions, the upstream direction will also be generally opposite, depending upon whether the description is of the heating gas or the water.

The evaporator section 26 includes vertical modules 31, which extend across the duct 20 so that the hot gas passes the vertical modules 31 and heats the water in the modules 31. The vertical modules 31 receive water from the conduit 29 through a header 33 and feed a steam/water mixture back to the drum 27 through the modules 31 and the risers 28. The risers 28 to the right of the conduit 29 feed into a common collection header 52, which has an outlet 58 into the drum 27. Each of the modules 31 in the evaporator is an upward-flowing, single pass module.

The boiling water passes upwardly through the risers 28 to the drum 27, which separates the water and steam. The steam then goes on to the superheater 17. The steam leaves the superheater 17 through a steam conduit 19, through a steam control valve 25, and to the steam turbine 14.

When the hot gas enters through the gas inlet 22, it first encounters the superheater 17, then the evaporator section 26, and then the economizer section 30. As shown in these drawings, the hot gas is the exhaust from a gas turbine, but it could be from another heat source, such as a burner, or it could be a combination of gas turbine exhaust and a supplemental heater.

Figure 3:
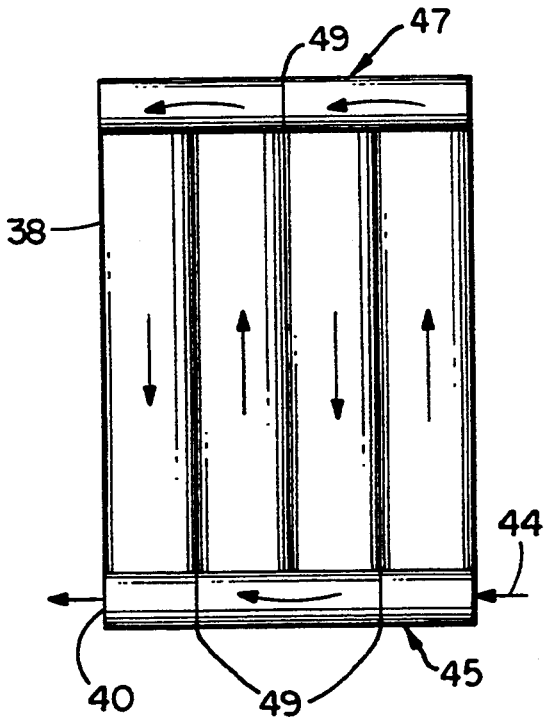
FIG. 3 is a schematic front view of a multi-pass plate in the economizer of FIG. 2.

The economizer section 30 includes two types of vertical modules. The upstream modules in the first embodiment are multiple pass modules 38, as shown in more detail in FIG. 3. The multiple pass module, shown in FIG. 3, includes a bottom header 45, a top header 47, and a plurality of tubes extending between and in fluid communication with the bottom header 45 and the top header 47. Both the bottom header 45 and the top header 47 include baffles 49 so that fluid must make multiple passes up and down within the multiple pass module before it can exit the module. In the multiple pass modules, the water enters at the bottom inlet 44, makes several passes up and down as it works its way across the module 38, and exits at the bottom outlet 40. The outlet 40 of one module 38 is connected to the inlet 44 of the next module 38 downstream, so that the water flows serially from one module 38 to the next, becoming warmer as it moves downstream. Multiple pass modules 38 are the preferred type of module in the economizer section, because they provide the necessary high water velocities, which provide the best heat transfer from the hot gas to the water.

Figure 4:
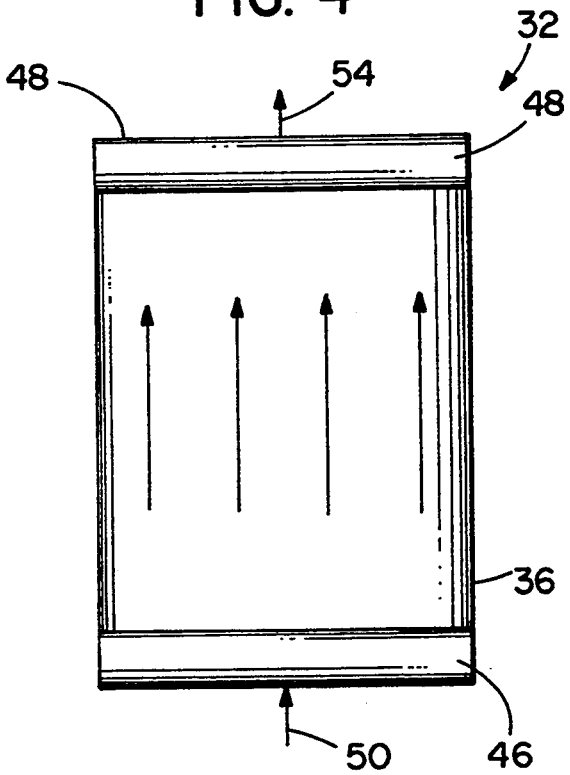
FIG. 4 is a schematic front view of an upwardly-flowing, single pass plate in the economizer of FIG. 2.

At the downstream end of the economizer section 30 are one or more upwardly-flowing single pass modules 36, which form the steaming section 32 of the economizer 30. In this embodiment, two such modules 36 are shown. Another view of the single pass module 36 is shown in FIG. 4. Water leaves the outlet 40 of the downstream-most multiple pass module 38, and enters a bottom inlet manifold 50, which feeds the water to the bottom headers 46 of the two upwardly-flowing single pass modules 36. While two upwardly-flowing single pass modules are shown here, the number of single pass modules at the end of the multiple-pass module portion may vary. The water goes up through the single pass modules 36 to the top headers 48 of the modules 36, then to a top outlet manifold 54, which leads to the conduit 56. This permits the output from the economizer 30 to use the same inlet 58 to the drum 27 as is used by some of the evaporator modules 31.

While the single pass modules do not provide the same velocities as the multiple pass modules and therefore are not as efficient and do not transfer as much heat per unit area of module, they play an important role in the present invention. The single pass modules 36 at the downstream end of the economizer section 30 provide for heat transfer and permit boiling at the downstream end of the economizer section without any problems being caused due to the boiling. Since the water becomes warmer and warmer as it progresses downstream along the economizer section, the boiling is most likely to take place near the downstream end of the economizer section. Putting the upwardly-flowing, single-pass modules 36 at the downstream end of the economizer section 30 means that, in the area where boiling is most likely to occur, the economizer 30 is designed so that boiling causes no problems.

The concept of designing the economizer section to permit boiling is contrary to the teaching in the art which says that various techniques must be used to prevent boiling in the economizer section.

In the preferred embodiment, a collection header 52 is located to collect the flow from the economizer 30 and the flow from some of the modules 31 in the evaporator section 26. The steam/water mixture flows through the collection header 52 into the steam drum 27.

Steam from the steam drum 27 passes into the superheater module 17, where it is heated above the boiling temperature and then leaves the boiler 16.

The boiler 16 shown in FIG. 1 also includes a by-pass system 60, which provides a second path for water that is leaving the economizer 30. The by-pass line 64 runs from the economizer output conduit 56 to a bypass valve 66, and then either out of the boiler (as shown) or back to the water inlet 45. The by-pass line 64 can be used to keep sufficient water flowing through the economizer 30 while cutting back on the amount of water flow to the evaporator 26 during transient conditions, as will be described later.

Figure 5:
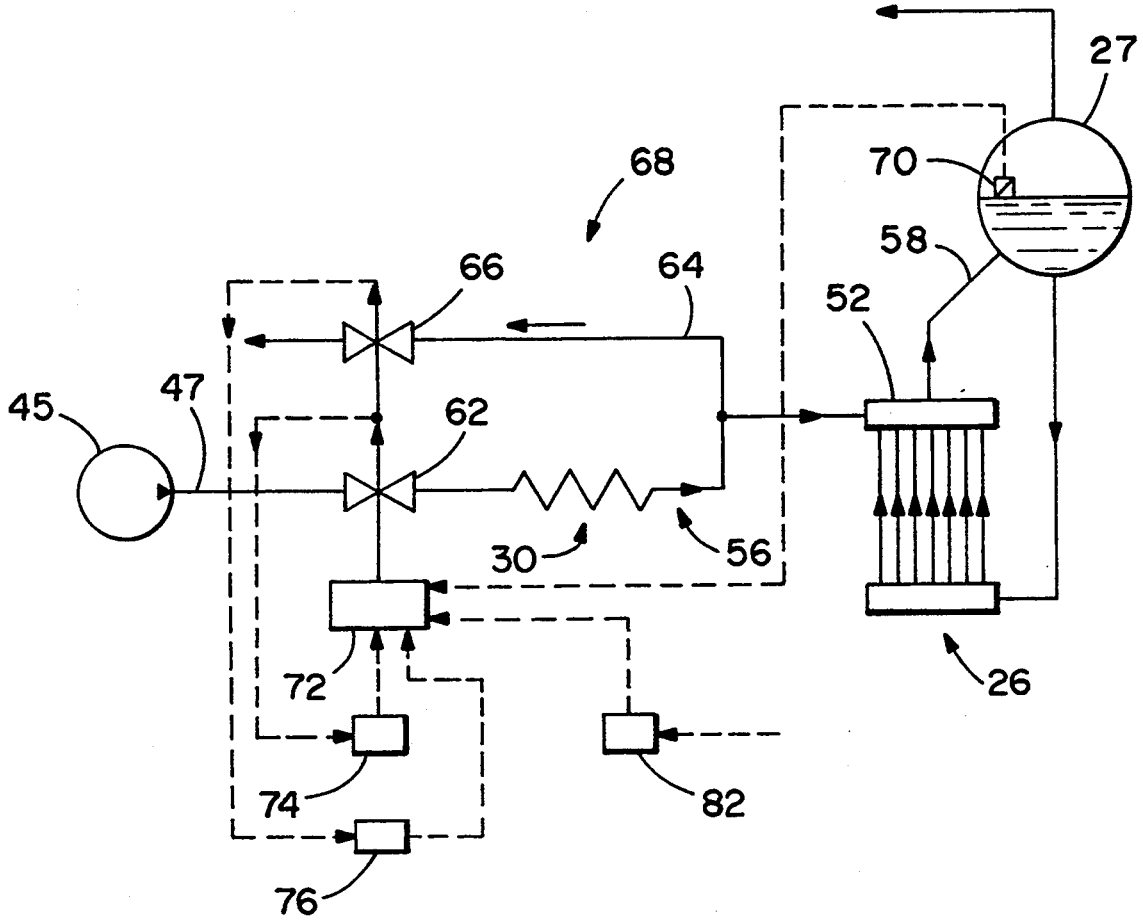
FIG. 5 is a schematic view of the control system for the boiler of FIG. 1.

FIG. 5 shows the feed water control system 68, which operates the water inlet valve 62 and the bypass valve 66. The control system 68 includes a water level sensor 70, which is located in the drum 27 to sense the level of water in the drum. The control system also includes a controller 72 which controls the water inlet valve 62 and the bypass valve 66. The controller 72 also receives signals from the water level sensor 70 in the drum 27. The control system also includes an inlet valve position sensor 74, which senses the position of the inlet valve 62 (by measuring the stroke of the valve or the flow rate in the inlet line 47), and a bypass valve sensor 76, which similarly senses the position of the bypass valve. Both the inlet valve sensor 74 and the bypass valve sensor 76 communicate with the controller 72. The control system also includes a load transmitter 82, which tells the controller 72 how much heat is coming into the gas inlet 22. The load transmitter 82 preferably determines the amount of heat input by measuring the position of the fuel valve for the fuel that is used to make the heat. This would be true whether there is a gas turbine upstream of the boiler, whether the fuel is being burned just to make heat for the boiler, or whether the heat input is a combination of heat from the gas turbine upstream and from a burner associated just with the boiler. (This would occur when a heat recovery steam generator is operating in fired mode.)

The controller 72 is preferably an electronic controller, which includes logic, control, and data processing capability, but it may be a combination of devices—electrical and/or mechanical—which perform the functions that are described below.

Figure 6:
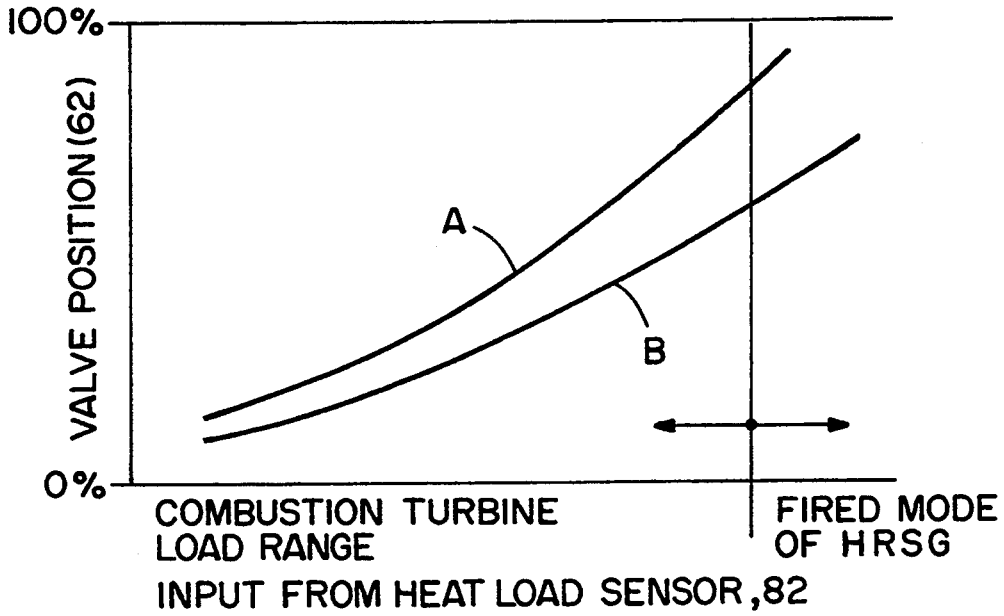
FIG. 6 is a curve which shows the valve positions the control system will use for the boiler of FIG. 1 at different heat loads.

FIG. 6 shows two curves, which can be calculated or determined by testing for any given boiler system. The curves, A and B, show the position the water input valve 62 should take for any given heat input to the boiler. The "A" curve shows the position the water input valve 62 should take under steady state conditions, and the "B" curve shows the minimum position the water input valve 62 should take under transient conditions to make the economizer reliable.

If the economizer does not include a portion that is designed to permit steaming, then the "B" curve would be the minimum valve position which would prevent steaming in the economizer. If the economizer does include a portion that is designed to permit steaming, then the "B" curve would be the minimum valve position which would prevent steaming in the portion of the economizer that is not designed for steaming (i.e., for the boiler shown in FIG. 1, the minimum valve position to prevent steaming in the multiple pass modules 38).

The curve "B" is programmed into the controller 72, so that, for any given heat input signal from the heat input transmitter 82, the controller 72 determines a minimum water input valve set point from the "B" curve.

When the power plant 10 is operating at steady state, the controller causes the water input valve 62 to open to the position on the "A" curve which permits enough water to enter the boiler to make up for the amount of steam leaving the boiler, and causes the bypass valve 66 to be closed.

If the load 18 rapidly increases, the steam turbine 14 will require more steam, so the steam output valve 25 is opened relatively rapidly. Now, the condition of the boiler changes from steady state to a dynamic or transient state of operation. Opening the steam output valve 25 to permit more steam flow to the turbine 14 causes the pressure in the boiler to drop. With the drop in pressure, more of the water in the evaporator will boil. The sudden increase in steam volume in the tubes 31 and in the risers 28 will push the water level in the drum 27 up. Under these conditions, the most urgent problem is to maintain the proper water level in the drum 27 in order to maintain the necessary steam quality. Also, it is desirable to provide enough water flow to the multiple pass modules 38 in the economizer section 30 to prevent steaming in the multiple pass modules 38. (Remember, steaming in the multiple pass modules 38 would create a steam hammer effect or fatigue problems, which are destructive to the modules.) With the design of this embodiment, we do not care if steaming occurs in the single-pass, upwardly-flowing modules at the end of the economizer section.

In the prior art, during normal operation of the boiler, the controller would simply look at the water level in the drum and reduce the flow through the water input valve to prevent the water level in the drum from becoming too high. However, in the present invention, the control operates differently.

To simultaneously maintain the water level in the drum 27 and provide reliable operation of the economizer 30, the present invention maintains a sufficiently large feed water flow to the economizer 30 to prevent boiling in the multiple pass modules 38 while providing a small supply of water to the drum 27.

As was mentioned earlier, for any heat input transmitted from the heat load transmitter 82 to the controller 72, the controller 72 determines a minimum set point for the water input valve 62. The controller knows that, no matter what, it is not to permit the water input valve 62 to close down more than that minimum set point.

If the controller 72 receives a signal from the sensor 70, telling it that the water level in the drum 27 is getting too high, it will cause the water input valve 62 to move from its first position, on the "A" curve, to a second position, which is either between the "A" and "B" curves or on the "B" curve, but which is not below the minimum set point position defined by the "B" curve. If the water input valve 62 has been closed to the position on the "B" curve, and the water level in the drum 27 is still too high, then the controller will begin to open the bypass valve 66 to allow water to flow through the bypass conduit 64, bypassing the drum 27, to maintain the proper level in the drum 27 while maintaining enough water flow through the economizer to prevent problems with boiling in the economizer.

The controller continues to monitor the water level in the drum 27, and, as the water level goes down, it gradually shuts off the bypass valve 66, and then opens the water input valve 62, until the water input valve 62 is again at the point on the "A" curve corresponding to the steady state position for the heat input to the boiler.

If there is a decrease in steam demand from the steady state operating position (with the bypass valve 66 closed and the water input valve 62 at the position on the "A" curve), the steam output valve 25 will be closed down somewhat, causing an increase in pressure in the evaporator 26. This will cause some of the steam in the evaporator to condense, and the decreased volume of steam in the modules 31 and risers 28 will cause the water level in the drum 27 to go down.

The water level sensor 70 will tell the controller 72 that the water level has dropped below the desired level. The controller 72 will then gradually open the water inlet valve 62 until the water level in the drum 27 again reaches the correct level. The controller 72 can open the water inlet valve 62 until it is completely open, but it will not close the water inlet valve 62 down below the minimum set point defined by the "B" curve.

Thus, in summary, the controller receives input telling it the water level in the drum, the heat input to the boiler, and the flow rates or valve positions for the water input line and the bypass line, and, based on that information and based on the curves "A" and "B", it controls the water input valve position and the bypass valve position to maintain the proper water level in the drum 27 while preventing steaming in the multiple pass portion of the economizer.

Figure 7:
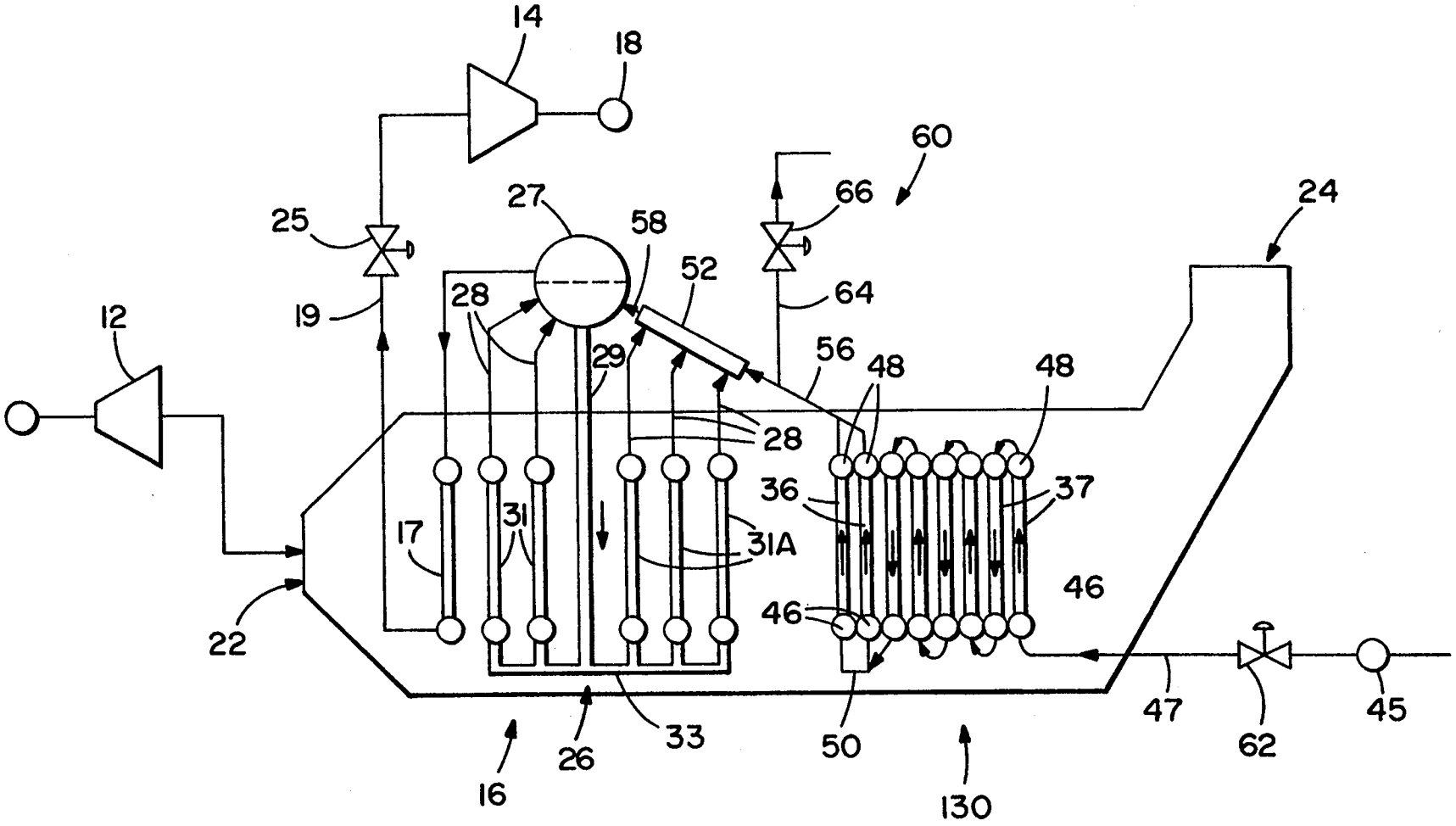
FIG. 7 shows a schematic side view of a second embodiment of a boiler made in accordance with the present invention.

The system shown in FIG. 7 is a second embodiment of the invention. This embodiment is the same as the first embodiment, except that, in this embodiment, the economizer section 130 has several single-path modules 37 connected together in series, so that water flows up the first module 37, down the second module 37, up the third module, and so forth. At the downstream end of this series of single-path modules are two upwardly-flowing single pass modules 36 connected in parallel. As with the first embodiment, there would be a problem if steaming occurred in or upstream of any downward-flowing portion of the economizer. As with the first embodiment, there is no problem if steaming occurs in the single-path, upwardly-flowing modules at the downstream end of the economizer section 130.

This second embodiment is controlled in the same manner as the first embodiment. An "A" curve and "B" curve are developed for the boiler, either empirically or by calculation. The "A" curve represents the positions of the water input valve 62 at steady state for any given heat input to the boiler, and the "B" curve represents the minimum set point positions of the water input valve 62 for any given heat input to the boiler.

As with the first embodiment, if the controller 72 notes that the water level in the drum 27 is becoming too high, it first reduces the water input flow by closing the water input valve 62 (never closing it below the minimum set point). If reducing the water input flow to the "B" set point is not sufficient to maintain the proper water level in the drum 27, then the controller 72 will begin opening the bypass valve 66 until the proper water level is reached in the drum 27. The controller 72 will then gradually close the bypass valve 66 until it is completely closed and will then gradually open the water inlet valve 62 until the water level in the drum 27 is where it should be.

Figure 8:
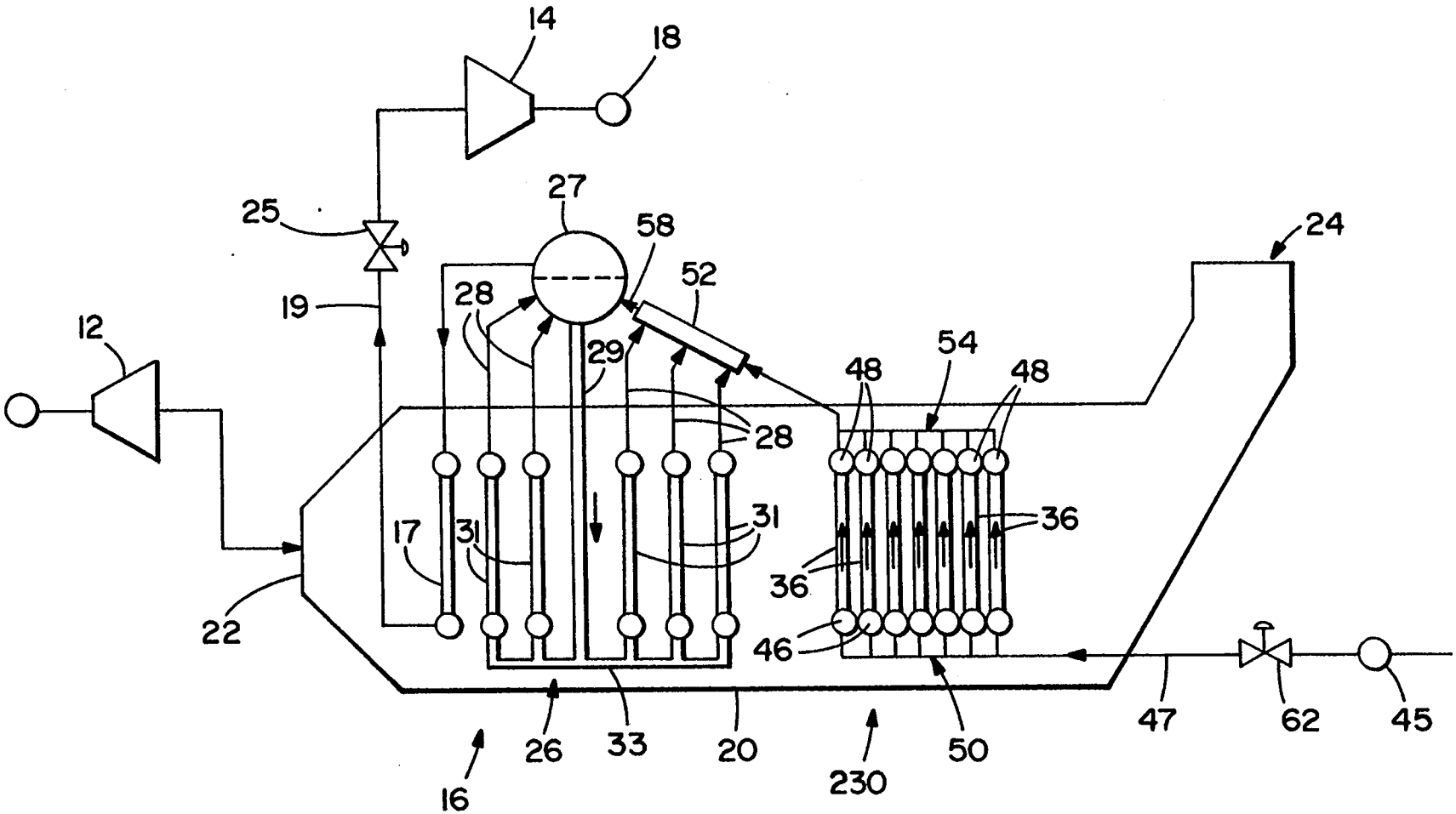
FIG. 8 shows a schematic side view of a third embodiment of a boiler made in accordance with the present invention.

FIG. 8 shows a third embodiment of the invention. This would be a very unusual arrangement, which could be used, for example, when the boiler is designed for operation at low pressure. In FIG. 8, everything is the same as in the first embodiment, with two exceptions. First, in this embodiment, the entire economizer section 230 is made up of single pass, upwardly-flowing modules 36 connected in parallel. Since the economizer section 230 of this embodiment does not include any downwardly-flowing paths, there can be steaming in any portion of this economizer section 230 without encountering any problems. Second, since steaming in the economizer section will not cause any problems, there is no need for a bypass system as in the two previous embodiments.

In the embodiment of FIG. 8, there is a bottom header 46 at the bottom of each module 36 and a top header 48 at the top of each module 36. A bottom inlet manifold 50 provides water to all the bottom headers 46 and receives water from the inlet pump 45. The collection header 56 collects the flow from all the top headers 48. The water or steam/water mixture from the collection header 56 enters the collection header 52, then flows through the drum inlet 58 into the drum 27.

Control of this system differs from the control of the previous embodiment, in that there is no bypass valve to control, and there is no concern about steaming in the economizer section, so this system can be controlled in the straightforward method of the prior art, which is simply to monitor the water level in the steam drum 27 and open or close the water input valve 62 to maintain the proper water level in the drum 27.

It will be obvious to those skilled in the art that modifications may be made to the embodiments described above without departing from the scope of the present invention.

What is claimed is:

1. In a natural circulation boiler, comprising an evaporators, a drum connected to the evaporator, and an economizer upstream of and in fluid communication with the evaporator; said economizer including a plurality of substantially vertical multiple pass fluid flow modules in fluid communication with each other; each multiple pass module including a bottom header, a top header, and a plurality of tubes extending between and in fluid communication with said bottom header and said top header, and at least one baffle in one of said headers, so that fluid entering the multiple pass module must flow at least once upwardly from the bottom header to the top header and at least once downwardly from the top header to the bottom header before leaving the multiple pass module, the improvement comprising:

at least one upwardly-flowing single pass module at the downstream end of said multiple pass fluid flow modules, said upwardly-flowing single pass module including a top header and a bottom header and a plurality of tubes extending between and in fluid communication with said respective top and bottom headers, wherein fluid enters said single pass module at the bottom header, travels only up to the top header and then out of the module, said single pass module having no downwardly-directed portion, so that, if steaming occurs at the end of the economizer, it will not be trapped in a downwardly-directed tube.

2. In a boiler as recited in claim 1, wherein there are two paths which the fluid leaving the economizer can take—a path into the evaporator and a bypass path in which the fluid leaving the economizer does not go into the evaporator; and further comprising a bypass valve in the bypass path, controlling the amount of fluid which takes the bypass path.

3. In a boiler, comprising an evaporator including a plurality of evaporator tubes, a drum for separating water and steam; a downcomer which directs water from the drum into the evaporator tubes and a collection header which receives the output from a plurality of the evaporator tubes and directs the output from said evaporator tubes into said drum; and an economizer including an output conduit; the improvement comprising:

the output conduit from said economizer is in fluid communication with said collection header, so that fluid leaving said economizer can enter said drum through said collection header, thereby avoiding the need for a special feedwater pipe from the economizer to the drum.

* * * * *

UNITED STATES PATENT AND TRADEMARK OFFICE

CERTIFICATE OF CORRECTION

PATENT NO. : 5,419,285

DATED : May 30, 1995

INVENTOR(S) : Gurevich et al.

It is certified that error appears in the above-indentified patent and that said Letters Patent is hereby corrected as shown below:

column 8, lines 16 and 17, claim 1:

"evaporators" should read --evaporator--.

Signed and Sealed this

Twenty-fifth Day of July, 1995

Bruce Lehman

*Attest:*

BRUCE LEHMAN

*Attesting Officer*

*Commissioner of Patents and Trademarks*